US008480544B2

(12) United States Patent
Solow et al.

(10) Patent No.: US 8,480,544 B2
(45) **Date of Patent: *Jul. 9, 2013**

(54) STACKABLE EXERCISE CHAIR

(75) Inventors: Howard J. Solow, Boulder, CO (US); James V. Osburn, Lafayette, CO (US); Julie Lobdell, Longmont, CO (US); Jeffrey T. Samson, Boulder, CO (US)

(73) Assignee: Mad Dogg Athletics, Inc., Venice, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/931,645

(22) Filed: Feb. 7, 2011

(65) Prior Publication Data

US 2011/0256991 A1 Oct. 20, 2011

Related U.S. Application Data

(63) Continuation of application No. 11/914,002, filed as application No. PCT/US2007/070934 on Jun. 12, 2007, now Pat. No. 7,883,447.

(60) Provisional application No. 60/804,751, filed on Jun. 14, 2006.

(51) Int. Cl.
*A63B 22/04* (2006.01)
*A63B 21/04* (2006.01)

(52) U.S. Cl.
USPC ..... 482/52; 482/130

(58) Field of Classification Search
USPC ..... 482/83, 91, 92, 121, 122, 123, 125, 482/129, 130, 135, 136, 137, 142, 145, 148; 434/247; 601/27, 29, 33, 34, 35; 297/423.12, 297/423.15, 423.22, 423.23, 423.24, 423.26, 297/423.28, 423.39, 423.41, 432.42
See application file for complete search history.

(56) References Cited

U.S. PATENT DOCUMENTS

| | | | | |
|---|---|---|---|---|
| 1,887,234 | A | 11/1932 | Copenhaver | |
| 5,002,271 | A | 3/1991 | Gonzales | |
| 5,380,262 | A | 1/1995 | Austin | |
| 5,681,250 | A | 10/1997 | Hoover et al. | |
| 6,338,493 | B1 | 1/2002 | Wohlgemuth et al. | |
| 6,634,997 | B2 * | 10/2003 | Breibart et al. | 482/130 |
| 6,916,279 | B2 * | 7/2005 | Endelman | 482/137 |
| 7,445,586 | B2 | 11/2008 | Gibson | |
| 7,608,030 | B2 * | 10/2009 | Splane | 482/142 |
| 7,883,447 | B2 * | 2/2011 | Solow et al. | 482/52 |
| 2003/0078143 | A1 | 4/2003 | Breibart et al. | |
| 2004/0138034 | A1 | 7/2004 | Endelman | |
| 2007/0037677 | A1 * | 2/2007 | Splane, Jr. | 482/121 |
| 2009/0197746 | A1 * | 8/2009 | Splane et al. | 482/121 |
| 2009/0270235 | A1 | 10/2009 | Solow et al. | |

OTHER PUBLICATIONS

Advertisement, Balanced Body, Inc., "New EXO Chair", 1 page, date unknown.

* cited by examiner

*Primary Examiner* — Oren Ginsberg

(57) ABSTRACT

An exercise chair of the type wherein a user can sit on a seating platform and extend and retract his legs while his feet are resting on a spring-resisted foot rod includes a movable bar for pivotally supporting the foot rod and which is positionable in an operative position or a storage position. In the operative position, the foot bar is positioned for desired use in pre-determined exercises while in the storage position it is positioned so as to permit nestable stacking of a plurality of the chairs.

10 Claims, 11 Drawing Sheets

STACKABLE EXERCISE CHAIR

CROSS REFERENCE TO RELATED APPLICATION

This is a continuation application of U.S. patent application Ser. No. 11/914,002, filed on Nov. 9, 2007, which is a continuation of a Patent Cooperation Treaty patent application claiming priority to U.S. provisional Application No. 60/804,751, filed Jun. 14, 2006, entitled "Stackable Exercise Chair."

BACKGROUND OF THE INVENTION

1. Field of the Invention

A chair for use by an individual during exercise includes a seat platform mounted on a base with the base movably supporting a pivotal transverse bar on which is mounted a stanchion carrying a foot-engaging rod on its free or distal end. Adjustable spring resistance connects the seat to the stanchion so that a user seated on the platform can, for example, place his or her feet on the transverse rod and move the rod in a reciprocating pattern during an exercise.

2. Description of the Relevant Art

Exercise by human beings has become increasingly popular for health and other related reasons. Such exercise takes numerous forms including aerobics, strengthening and more recently exercises related to Pilates, Gyrotonics and the like. Some of these exercises can be done without equipment while others require equipment. One exercise associated with Pilates requires a chair having a spring resistive foot rod which a user can reciprocally move with his feet. An exercise chair for use in such an exercise is shown in U.S. Pat. No. 6,634,997. Inasmuch as these chairs can be used at home or in a class setting where there are numerous such chairs, storage for the chairs becomes an issue. For example, a chair of the type shown in the afore-described U.S. patent, if used in a class setting, requires substantial space for storage when there are a plurality of such chairs. Accordingly, while the chair itself serves a useful purpose, it would be far more desirable if it could be stored in a manner requiring less space which, of course, is valuable in exercise facilities such as health clubs.

It is to provide an improved exercise chair that can be stored in a small amount of space that the present invention has been developed.

SUMMARY OF THE INVENTION

The exercise chair of the present invention has been designed to be nestable so as to conserve space when a plurality of the chairs are placed in storage.

The chair includes an open base having a seat platform supported thereon with a plurality of support legs which taper inwardly and upwardly to the seat platform that is smaller than the opening in the base. A movable transverse support bar is connected to the base so as to be positionable in an operative or storage position. The support bar is also pivotal about its longitudinal transverse axis and supports a stanchion having a transverse foot rod mounted on a distal end thereof in substantially parallel relationship with the movable bar. The stanchion is attached to coil springs operably anchored to the seat platform and slidably connected to the stanchion to adjustably resist pivotal movement of the stanchion about the movable bar.

In one operative position, the foot rod is spaced from the seating platform so that a user of the chair can sit on the platform while placing his feet on the foot rod and reciprocally pivot the foot rod away from the seat platform where it will be returned by the coil springs. When the movable bar is placed in the storage position, the movable bar, foot rod and the stanchion interconnecting the two are positioned so as not to inhibit the stacking of one chair on another. The inwardly and upwardly tapered support legs for the seating platform permit the relatively large, open base to be passed over the seating platform of the next adjacent lower seat so the open base rests on the tapered support legs in a nesting relationship.

Other aspects, features and details of the present invention can be more completely understood by reference to the following detailed description of a preferred embodiment, taken in conjunction with the drawings and from the appended claims.

DESCRIPTION OF THE PREFERRED EMBODIMENTS

Figure 1:
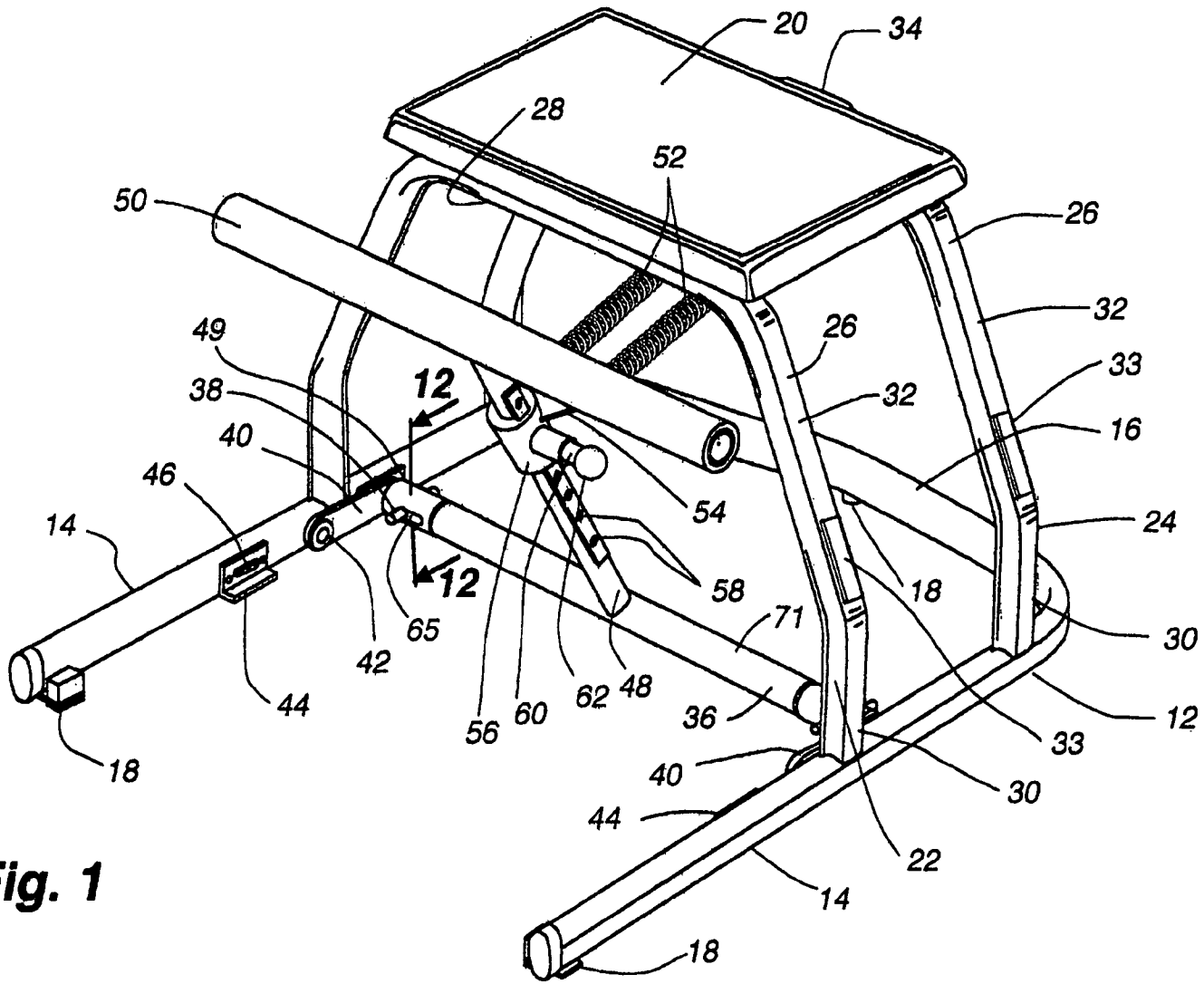
FIG. 1 is an isometric of a first embodiment of the present invention showing the movable bar in its operative position.
Figure 2:
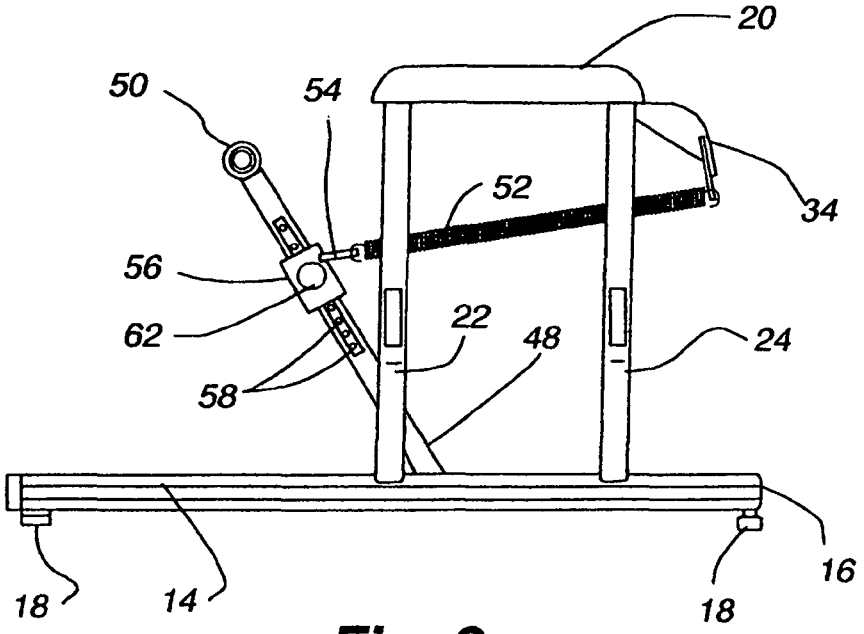
FIG. 2 is a left side elevation of the chair of FIG. 1.
Figure 3:
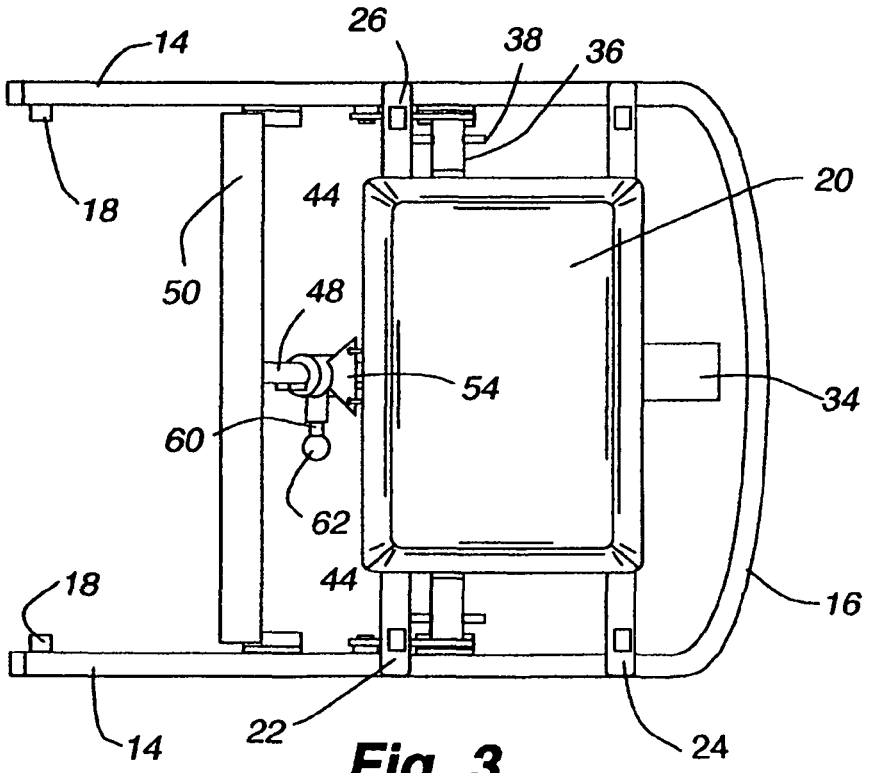
FIG. 3 is a top plan view of the chair of FIG. 1.

A first embodiment of the exercise chair of the present invention is shown in FIG. 1 to include an open generally U-shaped base frame 12 made for example of tubular steel, aluminum, plastic, or the like, having sides 14 and an end 16 interconnecting the sides at one end thereof. The sides are spaced a pre-determined distance which will become apparent hereafter. Ground or floor engaging pads 18 may be provided along the length of the base to elevate the base from a supporting surface if desired. A seating platform 20 is mounted in an elevated position from the base by a pair of parallel front 22 and rear 24 support leg structures which are generally inverted U-shaped in configuration. Each leg structure therefore defines a pair of side legs 26 and a top leg 28. The side legs have a lower vertical component 30 and an upper inwardly tapering component 32 having rubber strips or bumper pads 33 thereon for a purpose to be described later. The top leg is secured to the seating platform in any suitable manner as with bolt type fasteners. The lower end of each side leg is welded, screwed, or otherwise secured to a side of the base so that the seating platform is vertically supported and horizontally oriented above the base. The support leg structures are spaced forwardly from the end 16 of the base for a purpose to become clear hereafter and an anchor or mounting bracket 34 is secured along the rear edge of the seating platform so as to depend downwardly. The bracket can also be secured to the rear support leg structure if desired.

Figure 5:
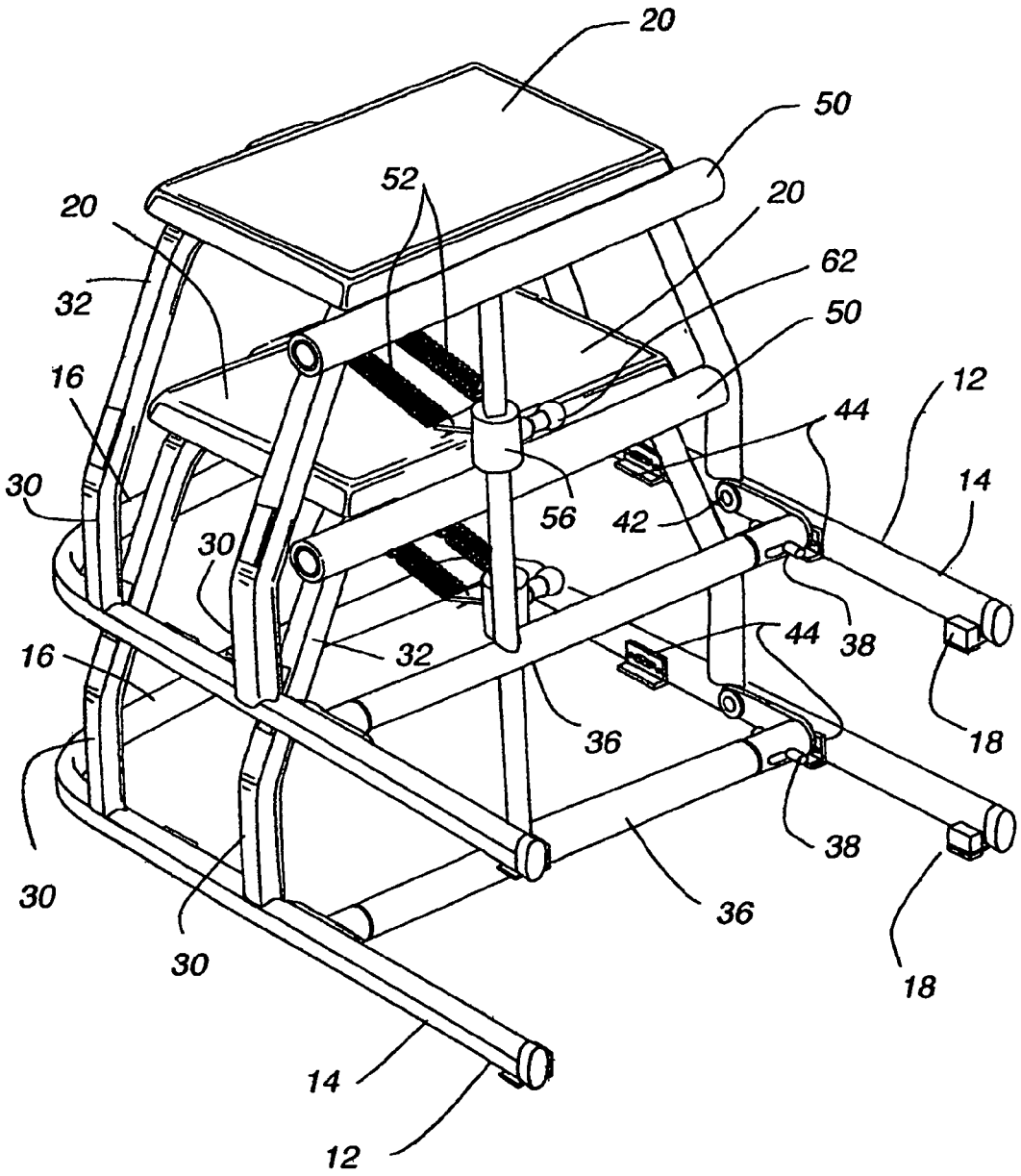
FIG. 5 is an isometric of the two nestably stacked chairs of FIG. 4.

A movable transverse bar 36 bridges the space between the two sides 14 of the base 12 in a perpendicular relationship therewith and approximately midway along the length of the sides. The movable bar is movable between an operative position as shown in FIG. 1 which is behind the front leg support structure 22 and a storage position as shown in FIG. 5 in front of the front leg support structure. The operative and storage positions are displaced longitudinally of the sides 14. The movable bar has depressible plungers 37 (FIG. 12) on opposite ends thereof which are spring biased outwardly in an axial direction from each end of the movable bar. The plungers can be retracted with a transverse finger pin 38 at each end of the movable bar. The plungers extend through holes in the free ends of a pair of pivotal links 40, the opposite ends of which are pivotally connected to an associated side 14 of the base with a pivot pin 42. The links permit the movable bar to swing or be pivoted between the operative position of FIG. 1 and the storage position of FIG. 5. The movable bar is supported in either the operable or storage position by support brackets 44 that are secured to the sides of the base at longitudinally spaced locations so as to be alignable with the ends of the movable bar. Each support bracket has a slot 46 therein that releasably receives a plunger 37 at the associated end of the movable bar so that the movable bar can be positively but releasably retained in either the operative position of FIG. 1 or the storage position of FIG. 5. The plunger can be withdrawn from a support bracket without being removed from the associated link thereby freeing the movable bar for swinging movement between the operative and storage positions.

Figure 12:
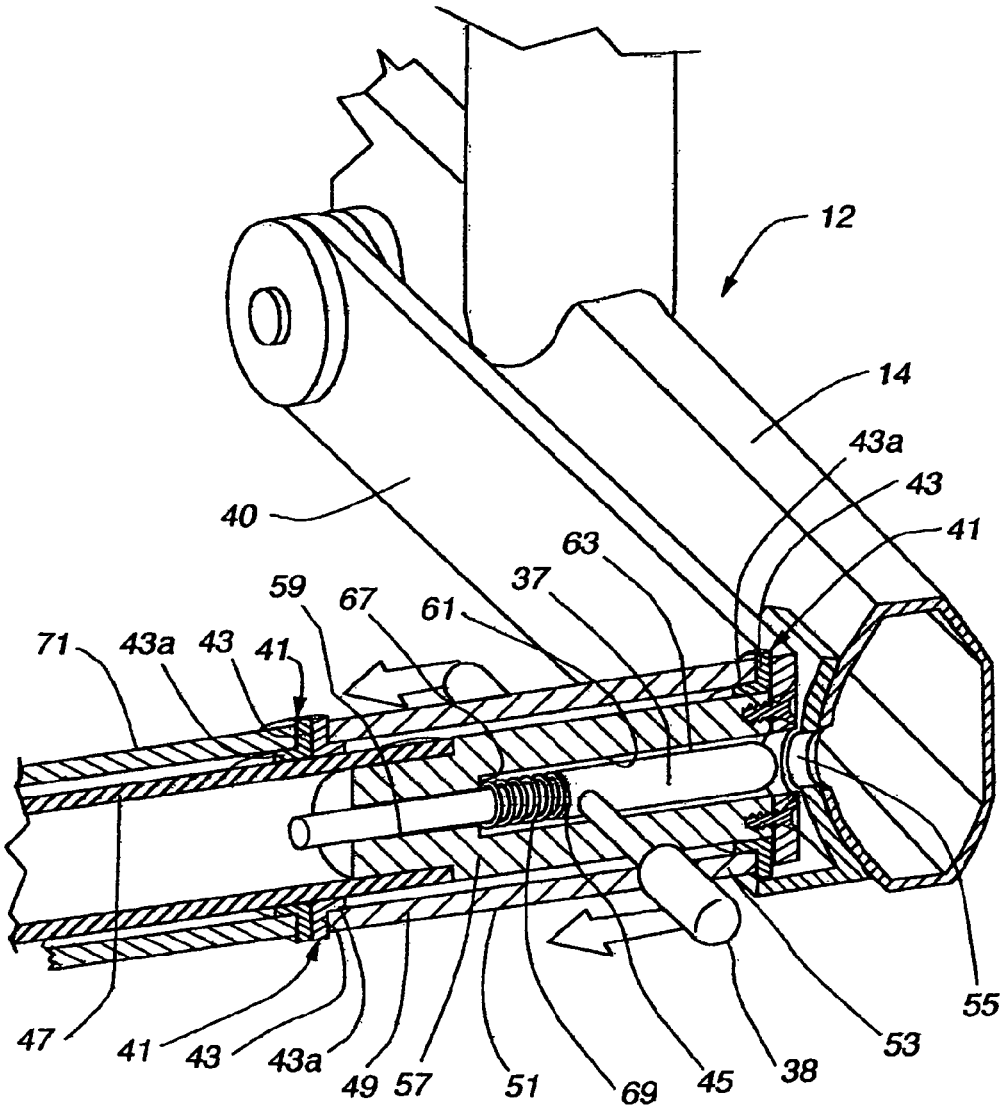
FIG. 12 is an enlarged fragmentary section taken along line 12-12 of FIG. 1.

As probably best seen in FIG. 12, the movable transverse bar 36 in the preferred embodiment, is comprised of a hollow support tube 47 that extends most of the full width between the sides 14 of the base frame 12 with the support tube being welded internally at each end around the periphery of inner ends of internal rods 57. An extension tube 51 surrounds each rod 57 and is held in radially spaced relationship therefrom by flanged bushings 41. A hollow sleeve 71 pivotally surrounds the support tube 47 in axial alignment with the extension tubes 51 and is separated from the extension tubes by a pair of identical flanged bushings 41. The flanged bushings have a large diameter portion 43 that abuts adjacent ends of the hollow sleeve and/or the extension tubes and a small diameter portion 43*a* having an outer surface that is press fit within the adjacent open end of the hollow sleeve or extension tube and an inner surface slidably engaged with the support tube 47 or the rod 57. The outer end of each internal rod 57 is screwed or otherwise attached in perpendicular relationship with a free end of an associated link 40 in alignment with a hole 55 in the link through which a plunger 37 mounted in each internal rod slidably projects. The internal rod 57 has an axial hole 59 through its inner end that communicates with a larger axial chamber 61 that opens through its outer end 63. The plunger has an inner small diameter segment that slides within the axial hole 59 and a large diameter segment that slides within the axial chamber 61. A shoulder 45 is defined on the plunger between the large and small diameter segments. The plunger has the transverse finger pin 38 secured thereto within the axial chamber. The finger pin extends through the plunger and through slots 65 (FIG. 1) in the extension tubes for access to a user. The axial chamber defines a shoulder 67 against which a coil spring 69 is seated in circumferential relationship with the plunger 37 and in abutment at its opposite end with the shoulder 45. The coil spring, therefore, biases the plunger axially outwardly. The plunger can be retracted, however, by the finger pin as when the transverse movable bar 36 is being pivoted relative to the base frame. The afore-described arrangement is positioned at each end of the movable transverse bar so the movable transverse bar can be releasably anchored to each side 14 of the base frame 12 in two different positions.

The hollow sleeve 71 is pivotally mounted on the support tube 47 and abuts a bushing 41 at each end so it cannot slide axially. The sleeve has the rigid stanchion 48 fixed thereto which extends radially away from the sleeve at a centered location along the length of the sleeve. The stanchion has a rigid foot engagement rod 50 fixably mounted perpendicularly across its free or distal end so as to define locations where a user of the exercise chair can place his feet or hands during exercise.

It will be appreciated from the above, the foot rod 50 is therefore pivotal about the support tube with this movement being restrained by a pair of coil springs 52 anchored at a rear end to the mounting bracket 34 on the seat platform 20 and at a front end to a flange 54 on a slide or sleeve 56 which is axially movable along the length of the stanchion 48. The stanchion includes a plurality of laterally opening detents 58 along its length for releasable receipt of a pin 60 mounted in the sleeve and spring-biased radially inwardly. A finger knob 62 is provided on the pin for retracting the pin from a detent in the stanchion so the slide can be moved along the length of the stanchion between any one of a plurality of fixed positions. Each position is a different distance from the movable bar 36 changing the leverage provided by the stanchion 48. By adjusting the tension in the springs, of course, the resistance to pivotal movement of the foot rod 50 by a user of the device can be pre-selected.

Figure 4:
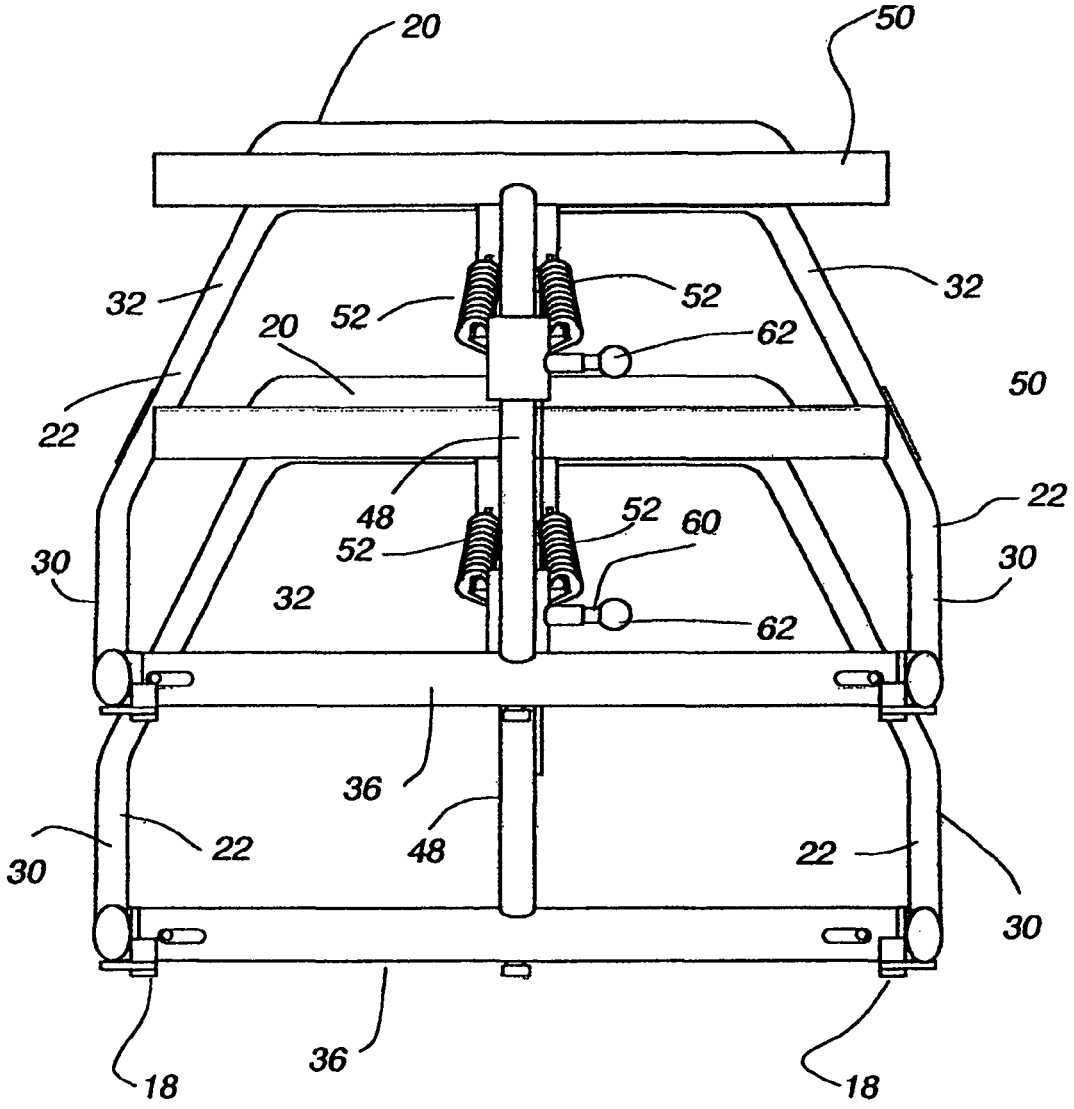
FIG. 4 is a front elevation of two nestably stacked chairs of the type shown in FIG. 1.

It is important to note the seating platform 20 has a width that is less than the spacing between the sides 14 of the base 12 and further that the seating platform is spaced forwardly from the end 16 of the base. This allows the base of one exercise chair to be moved downwardly over the seat of an underlying chair until the sides of the base rest on the rubber bumper pads 33 on the tapered upper components 32 of the leg structures 22 and 24 as best seen in FIGS. 4 and 5. As mentioned previously, however, in the operative position of the movable bar 36, it is positioned rearwardly or behind the front support leg structure 22 and is therefore in vertical alignment with the seating platform so that if one chair were moved downwardly over an underlying chair with its movable bar in the operative position of FIG. 1, the movable bar would engage the seating platform and prevent the upper chair from being lowered over the lower chair in a nested relationship. However, by pivoting the movable bar from the operative position of FIG. 1 to the storage position of FIG. 5, the movable bar is positioned forwardly of the seating platform and therefore will not restrict nesting of two exercise chairs. This can be clearly appreciated by reference to FIG. 5. Further, when the movable bar is in the storage position of FIG. 5, the foot rod 50 is pulled rearwardly by the coil springs 52 into engagement with the front support leg structure so that it too is not an obstruction to nesting of one exercise chair on an underlying chair.

As an alternative to the exercise chair shown in FIGS. 1-5, FIGS. 6-10 illustrate a second embodiment wherein like parts have been given like reference numerals with a prime suffix. In the second embodiment, a generally U-shaped base 12' having sides 14' and an end 16', support a seating platform 20' with a pair of upright generally inverted U-shaped support leg assemblies 22' and 24' having lower vertical components 30' and upwardly inwardly tapered upper components 32' with a top leg 28' being interconnected with the seating platform. An anchor bracket 34' for anchoring the rear ends of coil springs 52' is secured to the seating platform and/or the rear leg assembly 24' with the forward ends of the coil springs being secured to a flange 54' on a slide 56' movable along a stanchion 48' on a movable bar 36'. The free-end of the stanchion has a transverse foot rod 50' anchored thereon so that the foot rod can be pivoted about the movable support bar.

In this embodiment, however, the movable support bar 36' has fixed pins 64 (FIG. 9) axially extending from each end that are adapted to slide in sliding plates 66 secured on an inner face of each side 14' of the base 12'. The plates 66 have an elongated horizontal slot or track 68 therein that is downturned at each end to define detents 70 in which the pins 64 can be releasably positioned in the operative position of the movable bar of FIG. 6 and the storage position of FIG. 10. A rigidifying plate 72 is shown in this embodiment interconnecting the free ends of the sides 14' of the base which may or may not be used to establish and maintain the desired width of the chair but could be used in either embodiment of the invention.

Figure 6:
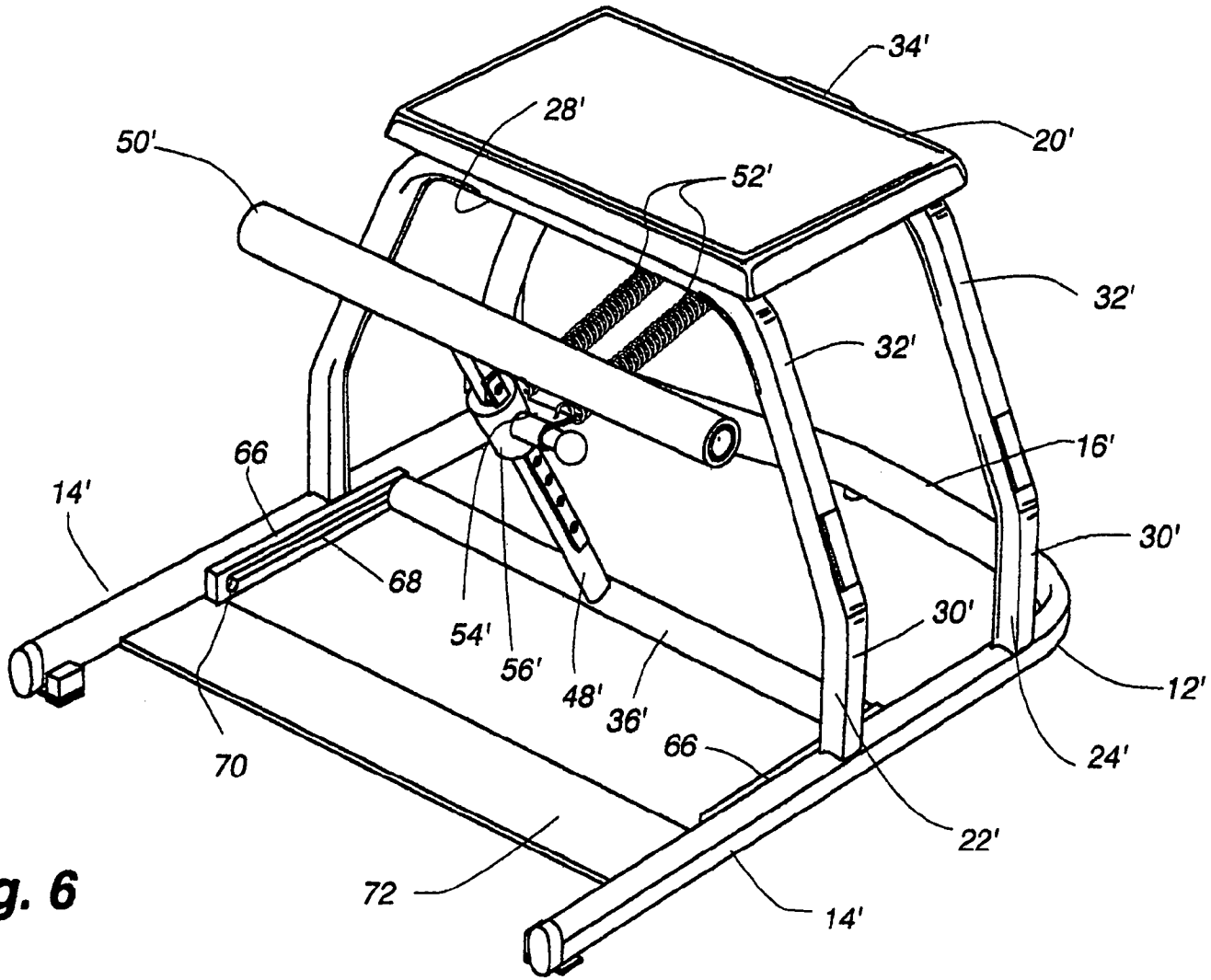
FIG. 6 is an isometric of a second embodiment of the exercise chair of the present invention with the support bar in its operative position.
Figure 8:
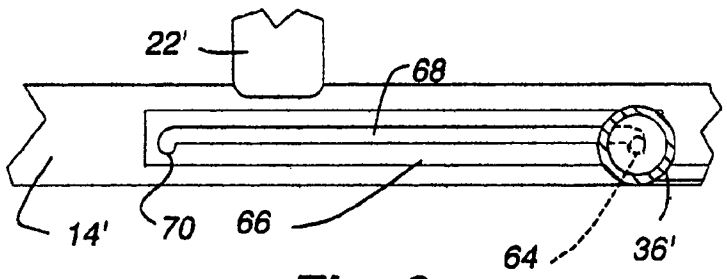
FIG. 8 is an enlarged fragmentary section taken along the line 8-8 of FIG. 7.
Figure 9:
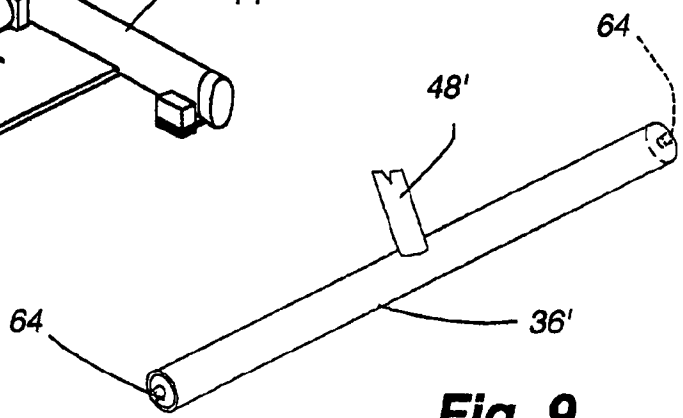
FIG. 9 is a fragmentary isometric of the movable bar.
Figure 7:
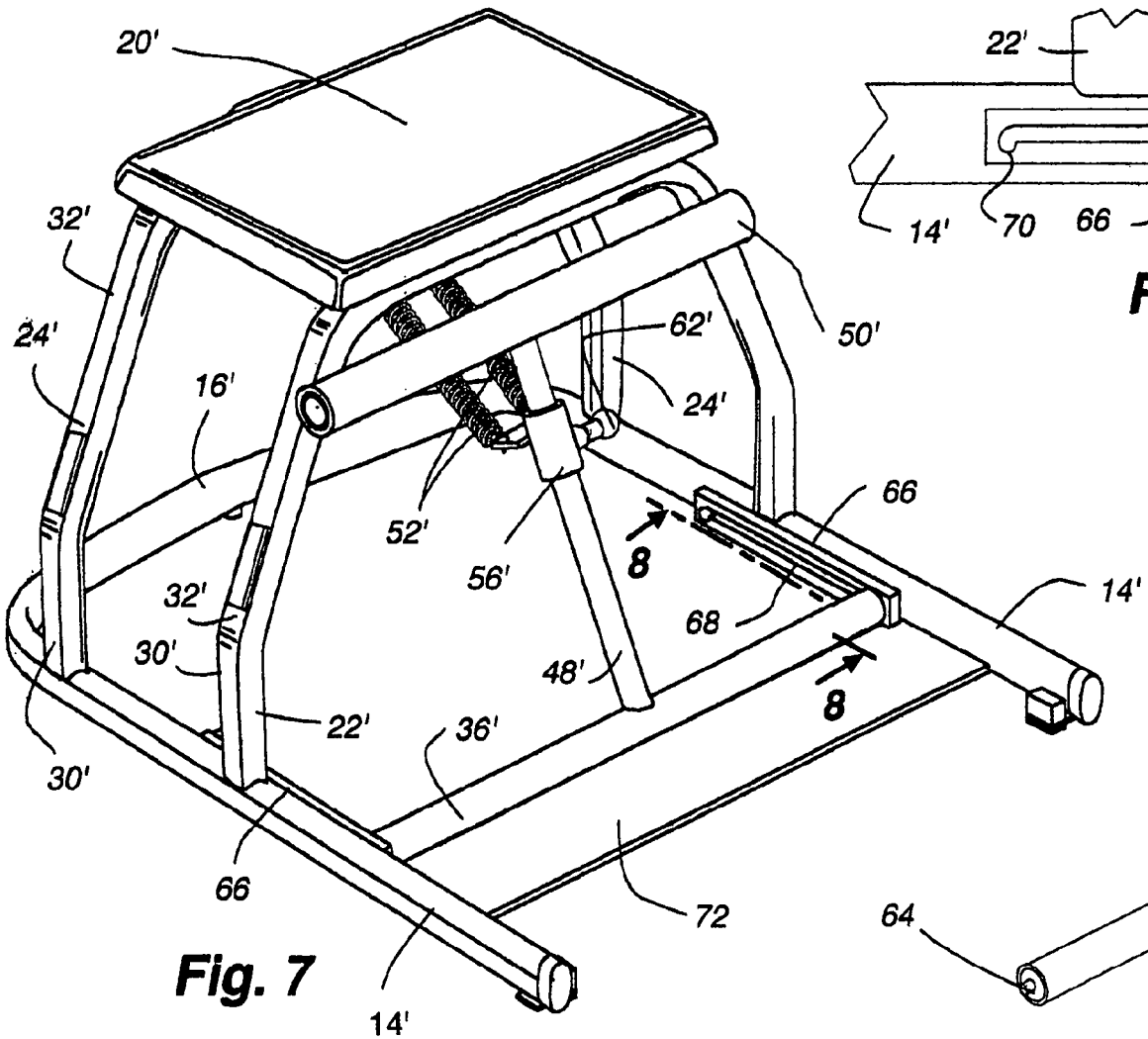
FIG. 7 is an isometric of the chair of FIG. 6 with the movable bar in its storage position.
Figure 10:
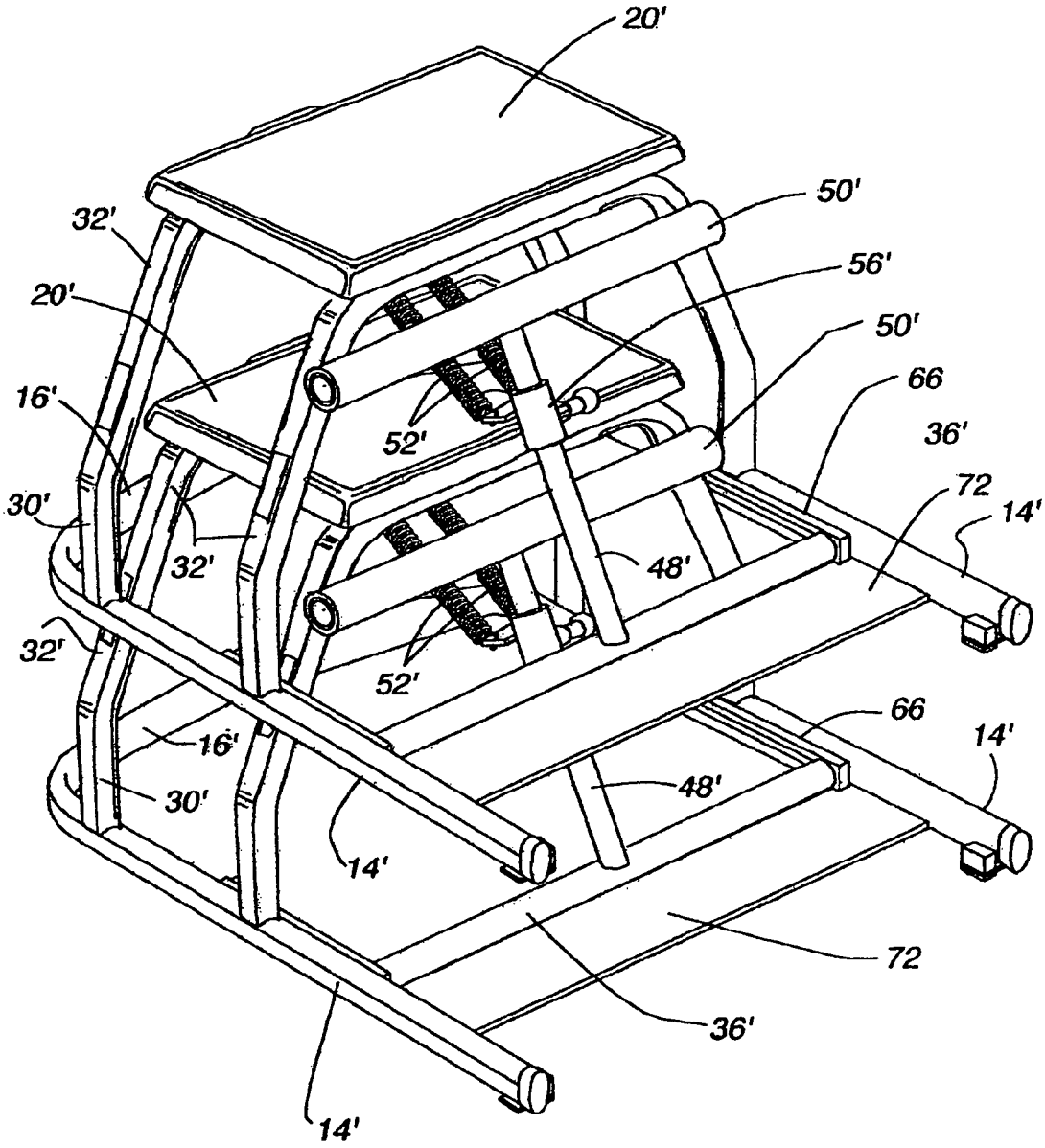
FIG. 10 is an isometric of two exercise chairs of the type shown in FIG. 6 in a nestably stacked position.

With the movable bar 36' positioned in its operative position of FIG. 6, it will be appreciated a user of the exercise chair seated on the seating platform 20' could place his feet on the foot rod 50' and reciprocally pivot the rod about the movable bar. When storing a plurality of chairs in a stacked and nested relationship as shown in FIG. 10, the movable bar is slid forwardly and releasably fixed in the detent 70 at the forward end of the slot 68 so that the movable bar is in front of the front support leg structure 22' and the foot rod is resting against the front of the front leg structure. In this position, as with the first embodiment, one chair can be moved downwardly over an underlying chair so the sides 14' of the base 12' move past the seating platform 20' and rest upon the tapered upper segment 32' of the support legs for the seating platform. With the movable bar positioned forwardly of the seat platform and the foot rod 50' tilted rearwardly into engagement with the front support leg structure, clearance is provided for the base 12' of one chair to fit down over the seating platform 20' and the foot rod 50' of an underlying chair until the sides of the base rest on the tapered upper segments of the support legs.

Figure 14:
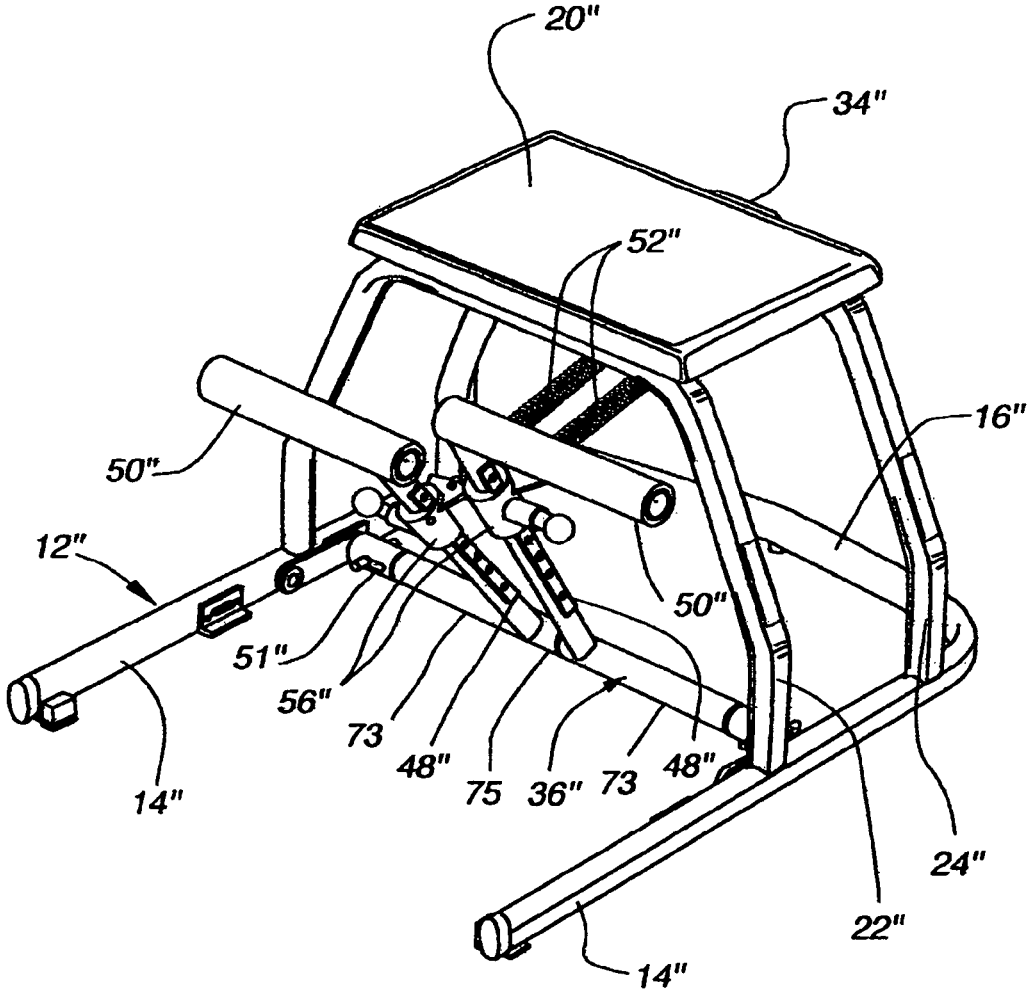
FIG. 14 is an isometric of still a further embodiment of the chair of the present invention.

In a further embodiment to that illustrated in FIGS. 1-5 and shown in FIG. 14, wherein like parts have been given like reference numerals with a double prime suffix, the exercise chair again has a base frame 12" having sides 14" and an end 16". A seating platform 20" is again mounted in an elevated position from the base by a pair of front 22" and rear 24" support leg structures which are generally inverted U-shaped in configuration. A movable transverse bar 36" in this embodiment of the chair instead of having one sleeve 71 includes two axially aligned but independently pivotal sleeves 73 that are separated and confined by flanged bushings 75 and mounted on a support tube 47". The sleeves 73 are held in position by the flanged bushings at opposite ends thereof. Each sleeve supports, on an inner end adjacent to the inner end of the other sleeve, a rigid stanchion 48" which supports on its outer distal end a rigid foot engagement rod 50". The foot engagement rods are separated so the feet engaging the foot rods can move independently of each other and with the foot rods pivoting about the support tube on which the associated sleeves are pivotally mounted. Each stanchion also has a slide 56" mounted thereon which is secured to a separate coil spring 52" whose opposite end is anchored to a mounting bracket 34" on a seat platform 20". With this embodiment of the invention, it will be seen that different exercises can be performed than those with the embodiment illustrated in FIGS. 1-5.

Figure 11:
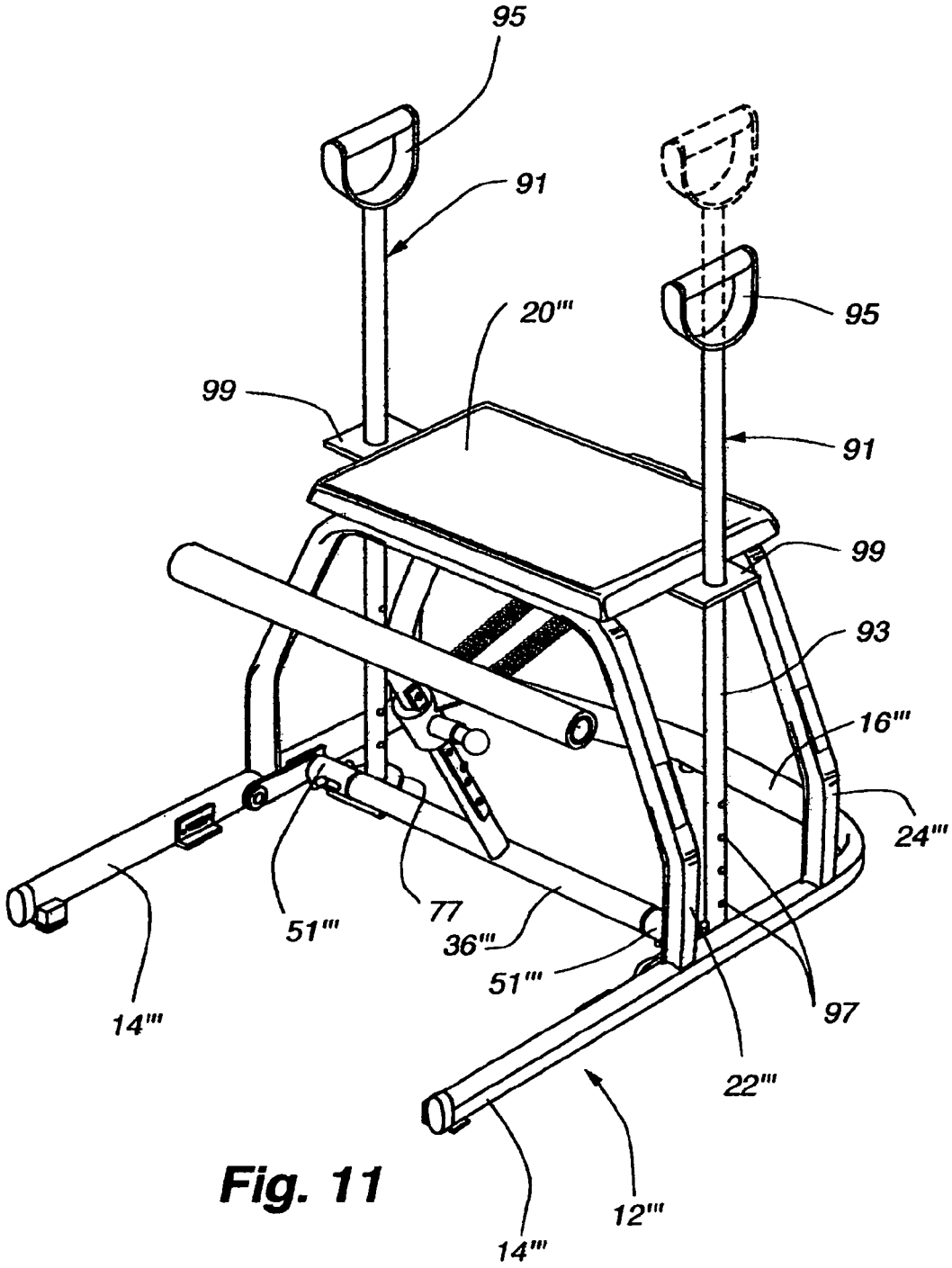
FIG. 11 is an isometric of an alternative to the embodiment of FIGS. 1-5.
Figure 13:
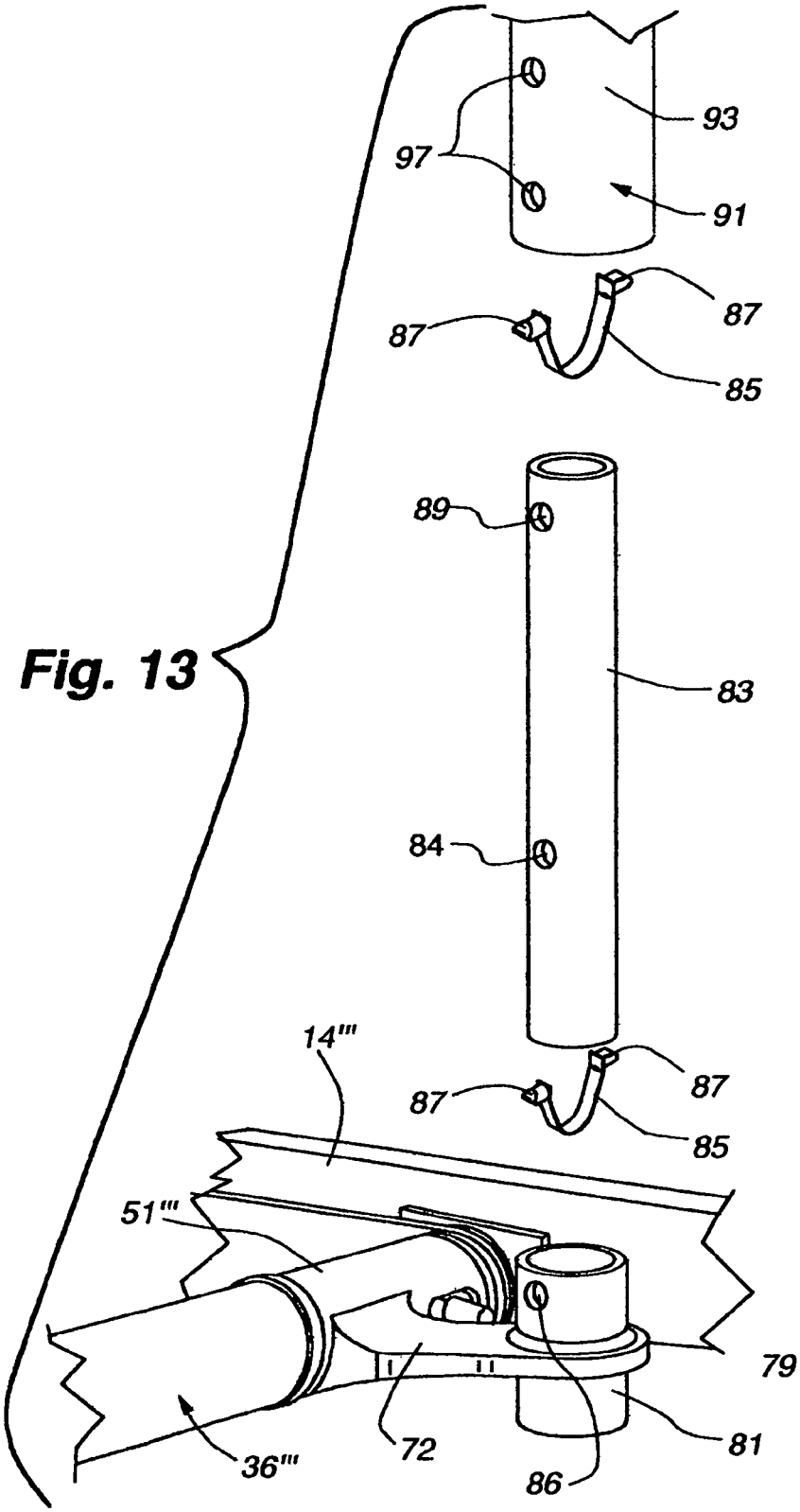
FIG. 13 is an enlarged exploded isometric of the lower end of the handles shown in FIG. 11.

In a still further embodiment of the invention from that illustrated in FIGS. 1-5 and shown in FIGS. 11 and 13, like parts have again been given like reference numerals but with a triple prime suffix. In this embodiment, the exercise chair again has a base frame 12'''; having sides 14''' and an end 16'''. A seating platform 20''' is again mounted in an elevated position from the base by a pair of front 22''' and rear 24''' support leg structures which are generally inverted U-shaped in configuration.

In this embodiment, the extension tubes 51''' have a rearwardly projecting bracket 72 welded or otherwise secured thereto so as to form a radial extension with the bracket rigidly supporting a vertical elongated hollow tube 81 that is welded to the bracket and extends upwardly and downwardly from the bracket. A support tube 83 is slidably and removably received in the tube 81 so as to project downwardly therefrom to define a leg for engagement with a support surface for the chair. The support tube 83 has a pair of diametrically opposed holes 89 at the top thereof and another pair 84 spaced slightly from the bottom thereof. A resilient spring lock 85 is seated in the support tube adjacent to each pair of holes 84 and 89 with the spring locks having outwardly directed pins 87 projecting out of the adjacent pair of holes. The hollow tube 81 also has a pair of diametrically opposed holes 86 which can be aligned with the holes 84 and pins 87 of the lower spring lock to thereby releasably connect the support tube 83 to the hollow tube 81.

There is a handle 91 at each side of the chair comprised of an elongated hollow tube 93 of slightly larger internal diameter than the external diameter of the hollow support tube 83 and having a hand grip 95 on its upper end. The hollow lower end of the elongated tube 93 has a plurality of vertically aligned and diametrically opposed holes 97 therein for releasable receipt of the pins on the upper spring lock so that by depressing the pins on the spring lock, the handle tube can be raised or lowered relative to the hollow support tube 83 to any desired degree. The handles also slidably pass through lateral extension brackets 99 on opposite sides of the seating platform 20''' to positively but slidably position the handles. The handles, of course, can be completely removed by lifting the handles off the hollow support tubes 83 after depressing the spring lock. The support tubes 83, with or without the handles connected thereto, can be removed from the hollow tubes 81 in the same manner. This leaves the chair in a condition where it can be stacked with other similar chairs and the handles can be stored separately. The handles and support tubes 83 would have to be removed in order to allow the movable bar 36''' to be shifted or pivoted from its use position shown in FIG. 1 to its storage position.

As will be appreciated from the above, an exercise chair has been described for accommodating physical exercises with the chairs being stackable to conserve space during storage. Even though the chairs can be stacked, with a very simple one-step move, they can be re-positioned for using during that exercise. It should also be noted features from the various embodiments can be interchanged or combined. For example, the handles shown in FIG. 11 could be incorporated into the split foot bar embodiment of FIG. 14 and either or both the handles and the split foot bar could be used with either system for moving the movable bar 36 between operative and storage positions shown in FIGS. 1 and 6.

Although the present invention has been described with a certain degree of particularity, it is understood the disclosure has been made by way of example, and changes in detail or structure may be made without departing from the spirit of the invention as defined in the appended claims.

What is claimed is:

1. A stackable exercise chair, comprising:

a base having sides separated by a distance;

legs that extend up from the sides and that are inwardly tapered;

a seat that is supported by the legs and that has a width less than the distance between the sides of the base;

a transverse bar that extends between the sides of the base and is rotatable about its longitudinal axis;

at least one pedal that is coupled to the transverse bar and that pivotally moves with the transverse bar;

a mounting system that couples the transverse bar to the sides of the base and that is configured to move the transverse bar between a storage position and an operating position; and at least one resistance member that biases the at least one pedal in a direction.

2. The stackable exercise chair of claim 1, wherein the mounting system includes links that pivotally couple the ends of the transverse bar to respective sides of the base, wherein the links move the transverse bar between the storage position and the operating position.

3. The stackable exercise chair of claim 1, wherein the mounting system includes slides mounted to each of the sides of the base wherein the ends of the transverse bar engage the slides to move between the storage position and the operating position.

4. The stackable exercise chair of claim 1, further comprising a member that couples the at least one pedal to the transverse bar, and wherein the at least one biasing member comprises a spring that is attached to the member.

5. The stackable exercise chair of claim 1, wherein the spring has a second end connected to the seat, to a bracket mounted to the seat or to one of the inwardly tapered legs.

6. The stackable exercise chair of claim 1, wherein when the transverse bar is in the storage position, the chair may be stacked on top of a second similarly configured chair.

7. The stackable exercise chair of claim 6, wherein when the chair is stacked on top of the second similarly configured chair, the base of the chair receives the seat of the second similarly configured chair.

8. The stackable exercise chair of claim 7, wherein the seat of the second chair fits in the distance between the sides of the base of the chair.

9. The stackable exercise chair of claim 1, wherein when the transverse bar is in the storage position, the at least one pedal is located substantially vertically above the transverse bar.

10. The stackable exercise chair of claim 1, further comprising two pedals.

* * * * *